US011215386B2

(12) United States Patent
Hellmann

(10) Patent No.: US 11,215,386 B2
(45) Date of Patent: Jan. 4, 2022

(54) REFRIGERATION CIRCUIT

(71) Applicant: Carrier Corporation, Palm Beach Gardens, FL (US)

(72) Inventor: Sascha Hellmann, Hessen (DE)

(73) Assignee: CARRIER CORPORATION, Palm Beach Gardens, FL (US)

( * ) Notice: Subject to any disclaimer, the term of this patent is extended or adjusted under 35 U.S.C. 154(b) by 323 days.

(21) Appl. No.: 16/088,284

(22) PCT Filed: Mar. 31, 2016

(86) PCT No.: PCT/EP2016/057070
§ 371 (c)(1),
(2) Date: Sep. 25, 2018

(87) PCT Pub. No.: WO2017/167374
PCT Pub. Date: Oct. 5, 2017

(65) Prior Publication Data

US 2019/0086130 A1 Mar. 21, 2019

(51) Int. Cl.
*F25B 43/00* (2006.01)
*F25B 5/02* (2006.01)
(Continued)

(52) U.S. Cl.
CPC ..... *F25B 43/006* (2013.01); *F25B 1/10* (2013.01); *F25B 5/02* (2013.01); *F25B 41/00* (2013.01);
(Continued)

(58) Field of Classification Search
CPC ..... F25B 43/006; F25B 1/10; F25B 41/00; F25B 41/04; F25B 41/003; F25B 41/043;
(Continued)

(56) References Cited

U.S. PATENT DOCUMENTS 2,249,622 A * 7/1941 Schlumbohm ..... F25B 43/043 62/85
5,103,650 A * 4/1992 Jaster ..... F25B 1/10 62/198
(Continued)

FOREIGN PATENT DOCUMENTS

EP 0976991 B1 6/2003
EP 1957888 B1 8/2009
(Continued)

OTHER PUBLICATIONS

International Search Report and Written Opinion for application PCT/EP2016/057070, dated Feb. 2, 2017, 14 pages.

*Primary Examiner* — Eric S Ruppert
*Assistant Examiner* — Kirstin U Oswald
(74) *Attorney, Agent, or Firm* — Cantor Colburn LLP

(57) ABSTRACT

Refrigeration circuit (1*a*) comprising in the direction of flow of a circulating refrigerant: a compressor unit (2) comprising at least one compressor (2*a*, 2*b*, 2*c*); a heat rejecting heat exchanger/gas cooler (4); a high pressure expansion device (6); a receiver (8); an expansion device (10); an evaporator (12); and a low pressure gas-liquid-separation unit comprising at least two collecting containers (32, 34) which are configured for alternately separating a liquid phase portion from the refrigerant leaving the evaporator (12) and delivering the separated liquid refrigerant back to the receiver (8).

9 Claims, 4 Drawing Sheets

(51) Int. Cl.

| | |
|---|---|
| ***F25B 41/04*** | (2006.01) |
| ***F25B 41/06*** | (2006.01) |
| ***F25B 1/10*** | (2006.01) |
| ***F25B 41/00*** | (2021.01) |
| ***F25B 41/20*** | (2021.01) |
| ***F25B 41/22*** | (2021.01) |
| ***F25B 41/31*** | (2021.01) |
| ***F25B 41/40*** | (2021.01) |
| *F25B 41/385* | (2021.01) |

(52) U.S. Cl.

CPC ..... *F25B 41/20* (2021.01); *F25B 41/22* (2021.01); *F25B 41/31* (2021.01); *F25B 41/40* (2021.01); *F25B 41/385* (2021.01); *F25B 2400/075* (2013.01); *F25B 2400/16* (2013.01); *F25B 2400/23* (2013.01); *F25B 2500/01* (2013.01); *F25B 2500/28* (2013.01); *F25B 2600/2519* (2013.01); *F25B 2700/04* (2013.01)

(58) Field of Classification Search

CPC ..... F25B 41/062; F25B 5/02; F25B 2500/01; F25B 2700/04; F25B 2341/0661; F25B 2400/23; F25B 2500/28; F25B 2400/075; F25B 2400/16; F25B 2600/2519; F25B 43/00

USPC ..... 62/83

See application file for complete search history.

(56) References Cited

U.S. PATENT DOCUMENTS

| | | | | |
|---|---|---|---|---|
| 5,134,859 | A | 8/1992 | Jaster | |
| 5,651,257 | A * | 7/1997 | Kasahara | C10M 171/008 62/84 |
| 8,769,982 | B2 | 7/2014 | Ignatiev et al. | |
| 8,776,539 | B2 | 7/2014 | Verma et al. | |
| 8,955,343 | B2 | 2/2015 | Verma et al. | |
| 9,217,590 | B2 | 12/2015 | Cogswell et al. | |
| 2011/0005268 | A1 | 1/2011 | Oshitani et al. | |
| 2011/0146313 | A1* | 6/2011 | Finckh | F25B 9/008 62/186 |
| 2012/0167601 | A1* | 7/2012 | Cogswell | F25B 1/10 62/115 |
| 2013/0111944 | A1 | 5/2013 | Wang et al. | |
| 2013/0312438 | A1* | 11/2013 | Kudo | F25B 31/002 62/84 |
| 2014/0283548 | A1 | 9/2014 | He et al. | |
| 2014/0326018 | A1 | 11/2014 | Ignatiev | |
| 2015/0013378 | A1 | 1/2015 | He et al. | |
| 2015/0345835 | A1 | 12/2015 | Martin et al. | |
| 2016/0138847 | A1* | 5/2016 | Zimmermann | F25B 5/00 62/384 |

FOREIGN PATENT DOCUMENTS

| | | | | |
|---|---|---|---|---|
| EP | 2596302 | B1 | 3/2014 | |
| EP | 3023713 | A1 * | 5/2016 | F25B 41/00 |
| GB | 1502607 | A | 3/1978 | |
| WO | 2014100330 | A1 | 6/2014 | |
| WO | 2014179699 | A1 | 11/2014 | |
| WO | 2015119903 | A1 | 8/2015 | |
| WO | 2016004988 | A1 | 1/2016 | |

* cited by examiner

REFRIGERATION CIRCUIT

The invention relates to refrigeration circuits, in particular to refrigeration circuits comprising a gas-liquid separation unit in the compressor suction line. The invention is further related to methods of controlling such refrigeration circuits.

In a refrigeration circuit a circulating refrigerant, which has been compressed by at least one compressor and cooled by a heat rejecting heat exchanger, is expanded by means of at least expansion one device, e.g. an expansion valve and/or an ejector, before it is vaporized in an evaporator for absorbing heat from the environment.

Usually the components of the refrigeration circuit are optimized for the most frequent operational conditions, but in general it is difficult to optimize the refrigeration circuit over the full range of varying operational conditions which are effected, inter alia, by varying ambient temperatures.

Thus, under some operational conditions, the refrigerant may not completely vaporize within the evaporator. As a result, a liquid phase portion of refrigerant is contained in the refrigerant leaving the evaporator and being delivered to the compressor(s). This results in a reduced efficiency of the refrigeration circuit, and may even damage the compressor(s).

Therefore, it is desirable to reliably prevent any liquid phase portion comprised in the refrigerant leaving the evaporator from reaching the compressor(s).

According to exemplary embodiments of the invention, as described herein, a refrigeration circuit comprises in the direction of flow of a circulating refrigerant: a compressor unit comprising at least one compressor; a heat rejecting heat exchanger/gas cooler; a high pressure expansion device; a receiver; an expansion device, in particular a normal cooling temperature expansion device; an evaporator, in particular a normal cooling temperature evaporator; and a low pressure gas-liquid-separation unit comprising at least two collecting containers. An outlet of the normal cooling temperature evaporator is fluidly connected to an inlet of a first collecting container, and an inlet side of the compressor unit is fluidly connected to the gas outlet of the first collecting container. A liquid outlet of the first collecting container is fluidly connected via an inlet valve to an inlet of the second collecting container, and a liquid outlet of the second collecting container is fluidly connected via an outlet valve to an inlet of the receiver.

The first collecting container in particular is arranged at a higher level than the second collecting container, which is arranged at a higher level than the receiver. Such an arrangement of the collecting containers allows the liquid phase portion to flow back into the receiver driven by forces of gravity without the need for providing a mechanical pumping mechanism.

According to an exemplary embodiment of the invention, a method of operating such a refrigeration circuit comprises the steps of: closing both valves for separating and collecting the liquid phase portion of the refrigerant in the first collecting container; opening the inlet valve for transferring the collected liquid refrigerant from the first collecting container to the second collecting container, closing the inlet valve and opening the outlet valve for transferring the liquid refrigerant from the second collecting container to the receiver.

Thus, according to this exemplary embodiment the first collecting container acts as a gas-liquid separator, while the second collecting container acts as a transfer container for transferring the liquid phase portion of the refrigerant, which has been separated and collected within the first collecting container, back to the receiver. Since the pressure within the receiver is higher than the pressure in the first collecting container/compressor suction line, the second collecting container is necessary for providing a pressure lock isolating the first collecting container from the receiver, while allowing the separated liquid phase portion of the refrigerant to pass by alternately opening the inlet valve and the outlet valve.

As a result, only the gas phase portion of the refrigerant is supplied to the compressor unit and the refrigeration circuit may be operated with high efficiency over a wide range of operational conditions.

According to a further exemplary embodiment of the invention, a refrigeration circuit comprises in the direction of flow of a circulating refrigerant: a compressor unit comprising at least one compressor; a heat rejecting heat exchanger/gas cooler; a high pressure expansion device; a receiver; an expansion device, in particular a normal cooling temperature expansion device; an evaporator, in particular a normal cooling temperature evaporator; and a low pressure gas-liquid-separation unit comprising at least two collecting containers. The refrigeration circuit further comprises an inlet valve unit which is configured for alternately connecting an outlet of the normal cooling temperature evaporator to an inlet of one of the collecting containers; a gas outlet valve unit which is configured for alternately connecting an inlet side of the compressor unit to a gas outlet of one of the collecting containers; and a liquid outlet valve unit which is configured for alternately connecting an inlet of the receiver to a liquid outlet of one of the collecting containers.

According to an exemplary embodiment of the invention, a method of operating such a refrigeration circuit comprises the step of controlling the valve units to alternately switch between at least two modes:

In a first mode, the outlet of the normal cooling temperature evaporator is fluidly connected to the inlet of a first collecting container, the inlet of the compressor unit is fluidly connected to the gas outlet of the first collecting container, and the first collecting container is fluidly separated from the receiver allowing to maintain a pressure difference between the first collecting container and the receiver.

In a second mode the outlet of the normal cooling temperature evaporator is fluidly connected to the inlet of the second collecting container, the inlet of the compressor unit is fluidly connected to the gas outlet of the second collecting container, and the second collecting container is fluidly separated from the receiver allowing to maintain a pressure difference between the second collecting container and the receiver.

In the first mode, the inlet of the receiver is at least temporarily fluidly connected to a liquid outlet of a second collecting container; and in the second mode the inlet of the receiver is at least temporarily fluidly connected to a liquid outlet of the first collecting container.

By alternately switching between the two modes, one of the collecting containers is temporarily isolated from the low pressure suction line of the compressor unit and fluidly connected to the receiver for allowing the separated liquid phase portion, which has been collected within said collecting container, being transferred back into the receiver. The first and second collecting containers are in particular arranged at a higher level than the receiver. This allows the liquid phase portion to flow back into the receiver driven by forces of gravity without the need for providing a mechanical pumping mechanism.

Both, the first and the second mode each are combined liquid collection and liquid transfer modes: In each of the two modes the liquid phase portion of the refrigerant is separated from the refrigerant leaving the evaporator in one of the collecting containers while the separated liquid refrigerant is transferred from the other collecting container back into the receiver.

As a result, only the gas phase portion of the refrigerant is supplied to the compressor unit and the refrigeration circuit may be operated with high efficiency over a wide range of operational conditions.

Exemplary embodiments of the invention are described in the following with respect to the enclosed Figures:

FIG. 1 illustrates a refrigeration circuit 1*a* according to a first exemplary embodiment of the invention.

Figure 1:
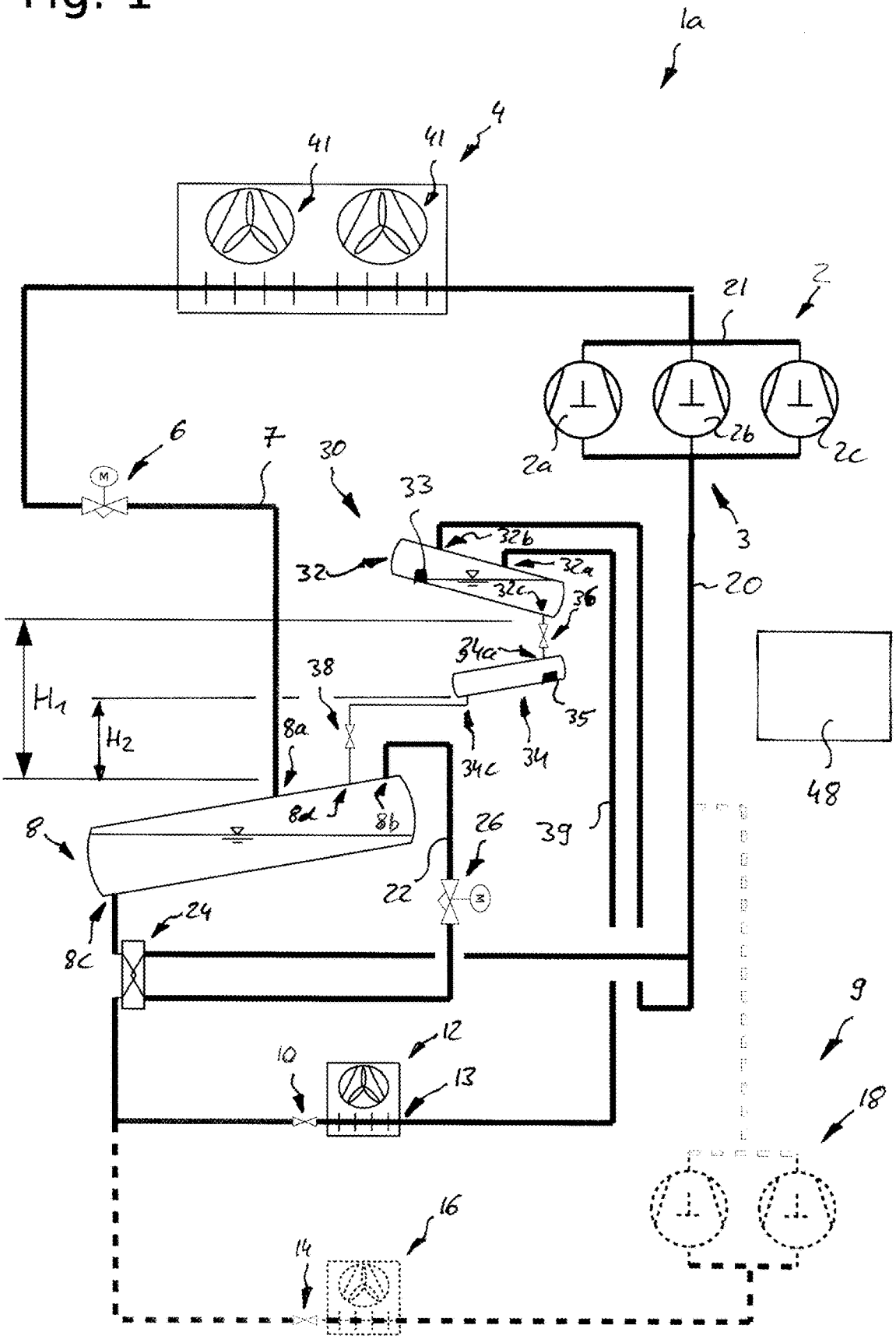
FIG. 1 is a schematic view of a refrigeration circuit 1*a* according to a first exemplary embodiment of the invention.

The refrigeration circuit 1*a* shown in FIG. 1 comprises a compressor unit 2 including a plurality of compressors 2*a*, 2*b*, 2*c* connected in parallel. In operation, the compressors 2*a*, 2*b*, 2*c* compress the refrigerant from a low inlet pressure to a high outlet pressure. The compressor unit 2 in particular may include an economizer compressor 2*a* and one or more standard compressor(s) 2*b*, 2*c*.

The high pressure outlets of the compressors 2*a*, 2*b*, 2*c* are fluidly connected to an outlet manifold 21 collecting the refrigerant output from the compressors 2*a*, 2*b*, 2*c* and delivering the compressed refrigerant to a heat rejection heat exchanger/gas cooler 4. The heat rejecting heat exchanger/gas cooler 4 is configured for transferring heat from the refrigerant to the environment thereby reducing the temperature of the refrigerant. In the embodiment shown in FIG. 1, the heat rejecting heat exchanger/gas cooler 4 comprises two fans 41 which may be operated for blowing air through the heat rejecting heat exchanger/gas cooler 4 in order to enhance the transfer of heat from the refrigerant to the environment. Of course, the number of two fans 41 is only exemplary and the heat rejecting heat exchanger/gas cooler 4 may comprise less or more fans 41 or even no fans 41 at all.

The cooled refrigerant leaving the heat rejecting heat exchanger/gas cooler 4 is delivered to a high pressure expansion device, in particular a high pressure expansion valve 6, which is configured for expanding the refrigerant from high pressure to a reduced (medium) pressure. The expanded refrigerant leaves the high pressure expansion valve 6 and is delivered via a receiver inlet line 7 to a first inlet 8*a* of a receiver 8 acting as a medium pressure gas-liquid-separator. The receiver 8 has a cross-section (diameter) which is considerably larger than the cross-section (diameter) of the receiver inlet line 7. In consequence, the flowing velocity of the refrigerant in the receiver 8 is considerably lower than in the receiver inlet line 7. As a result, the refrigerant separates into a liquid phase portion collecting at the bottom of the receiver 8 and a gas phase portion collecting in an upper portion of the receiver 8.

Refrigerant from the liquid phase portion of the refrigerant collecting at the bottom of the receiver 8 exits from the receiver 8 via a liquid outlet 8*c* and is delivered to a normal cooling temperature expansion device 10 (e.g., an expansion valve).

After having passed the normal cooling temperature expansion device 10, where it is expanded from medium pressure to a low pressure, the refrigerant enters into a normal cooling temperature evaporator 12. The normal cooling temperature evaporator 12 is configured for operating at "normal" cooling temperatures, i.e. in particular at temperatures in a range from 0° C. to 15° C. for providing "normal temperature" refrigeration.

Depending on the operational and environmental conditions, in particular the temperature difference between the environment of the heat rejecting heat exchanger/gas cooler 4 and the normal cooling temperature evaporator 12, the refrigerant leaving from an outlet 13 of the normal cooling temperature evaporator 12 may be a refrigerant mixture comprising a liquid phase portion and a gas phase portion. For enhancing the efficiency of the refrigeration circuit 1*a*, it is desirable to separate the liquid phase portion from the gas phase portion and to deliver only the gas phase portion to the inlet side 3 of the compressor unit 2.

For separating the liquid phase portion from the gas phase portion the refrigerant leaving the normal cooling temperature evaporator 12 via its outlet 13 is delivered to a low pressure gas-liquid-separator 30 comprising two collecting containers 32, 34.

The refrigerant in particular is delivered via a low pressure refrigerant line 39 to an inlet 32*a* of a first collecting container 32. The first collecting container 32 has a cross-section (diameter) which is considerably larger than the cross-section (diameter) of the low pressure refrigerant line 39. This difference between the cross-sections of first collecting container 32 and the low pressure refrigerant line 39 results in a considerable reduction of the flowing velocity of the refrigerant, e.g. from approx. 8 m/s to approx. 0.25 m/s. This reduction of the flowing velocity causes the liquid phase portion of the refrigerant to separate from the gas phase portion and to collect at the bottom of the first collecting container 32. As a result, only the gas phase portion of the refrigerant exits from the first collecting container 32 via a gas outlet 32*b* provided in an upper portion of the first collecting container 32, and is delivered via a refrigerant suction line 20 to the inlet side 3 of the compressor unit 2.

A liquid outlet 32*c* is provided at the bottom of the first collecting container 32 for allowing to extract the liquid refrigerant collected at the bottom of the first collecting container 32. The liquid outlet 32*c* is fluidly connected by means of an inlet valve 36 to an inlet 34*a* of a second collecting container 34. The second collecting container 34 is arranged at a lower height $H_2$ than the first collecting container 32 but at a higher level than the receiver 8. An outlet valve 38 is fluidly connected between a liquid outlet 34*c* provided at the bottom of the second collecting container 34 and a second inlet 8*d* of the receiver 8.

After the refrigeration circuit 2 has operated for a predetermined period of time and/or a certain amount of liquid refrigerant has been collected at the bottom of the first collecting container 32, a control unit 48 instructs the inlet valve 36 to open. The liquid refrigerant collected at the bottom of the first collecting container 32 may be detected by a liquid level sensor 33 which is arranged within or at the first collecting container 32 and delivers a liquid refrigerant detection signal to the control unit 48.

Since the first collecting container 32 is arranged at some height $H_1$ above the second collecting container 34, forces of gravity cause the liquid refrigerant to flow from the first collecting container 32 into the inlet 34*a* of the second collecting container 34 when the inlet valve 36 is open. The skilled person understands that the first collecting container 32 does not need to be arranged directly above, i.e. on a common vertical line with, the second collecting container 34. Instead, it is sufficient that the first collecting container 32 is arranged at a level of height which is above the level of height of the second collecting container 34.

After a predetermined period of time, which in particular is long enough for allowing almost all liquid refrigerant collected in the first collecting container 32 to transfer from the first collecting container 32 into the second collecting container 34, and/or when the liquid level sensor 33 detects that the level of liquid within the first collecting container 32 has fallen below a predetermined lower limit, the control unit 48 instructs the inlet valve 36 to close and the outlet valve 38 to open. Since the second collecting container 34 is arranged in some height $H_2$ above the receiver 8, forces of gravity cause the liquid refrigerant to flow form the second collecting container 34 into the receiver 8 when the outlet valve 38 is open.

Thus, the combination of the second collecting container 34, the inlet valve 36 and the outlet valve 38 functions as a pressure lock separating the medium pressure within the receiver 8 from the low pressure within the first collecting container 32, but allowing liquid refrigerant to be delivered from the first collecting container 32 back into the receiver 8 by alternately opening the inlet valve 36 and the outlet valve 38. From the receiver 8 the liquid refrigerant may be delivered again to the normal cooling temperature expansion device 10 and the normal cooling temperature evaporator 12.

The efficiency of the refrigeration circuit 1*a* may be enhanced even further by providing an (optional) flash-gas line 22 fluidly connecting a receiver gas outlet 8*b*, which is provided in the upper portion of the receiver 8, to the refrigerant suction line 20 of the compressor unit 2.

The flash-gas line 22 allows the gas phase portion of the refrigerant collecting in an upper portion of the receiver 8 to exit from the receiver 8 through the receiver gas outlet 8*b* and to flow into the refrigerant suction line 20 of the compressor unit 2. The flow of refrigerant through the flash-gas line 22 may be controlled by means of a flash-gas valve 26 provided in the flash-gas line 22.

Optionally, a flash-gas heat exchanger 24 may be arranged in the flash-gas line 22 for allowing a transfer of heat between the refrigerant leaving the liquid refrigerant through the liquid outlet 8*c* and the gaseous refrigerant leaving the receiver 8 through the gas outlet 8*b*.

The refrigeration circuit 1*a* may further comprise a low, i.e. freezing, temperature branch 9 which is configured for providing lower cooling temperatures than the normal cooling temperature evaporator 12, in particular freezing temperatures below 0° C., more particular temperatures in the range of −15° C. to −5° C. for allowing refrigeration at freezing temperatures.

The low temperature branch 9 of the refrigeration circuit 1*a* comprises a freezing temperature expansion device 14 (e.g., an expansion valve) which is fluidly connected to the liquid outlet 8*c* of the receiver 8. The freezing temperature expansion device 14 is configured for expanding the refrigerant to an even lower pressure than the normal cooling temperature expansion device 10.

The portion of the liquid refrigerant which has been expanded by the freezing temperature expansion device 14 enters into a freezing temperature evaporator 16, which in particular is configured for operating at freezing temperatures below 0° C., even more particular at temperatures in the range of −15° C. to −5° C. The refrigerant leaving the freezing temperature evaporator 16 is delivered to the inlet side of a freezing temperature compressor unit 18 comprising one or more freezing temperature compressor(s) 18*a*, 18*b*. The freezing temperature compressor unit 18 compresses the refrigerant to the low pressure of the refrigerant within the refrigerant suction line 20 and delivers the compressed refrigerant into said refrigerant suction line 20.

Figure 2:
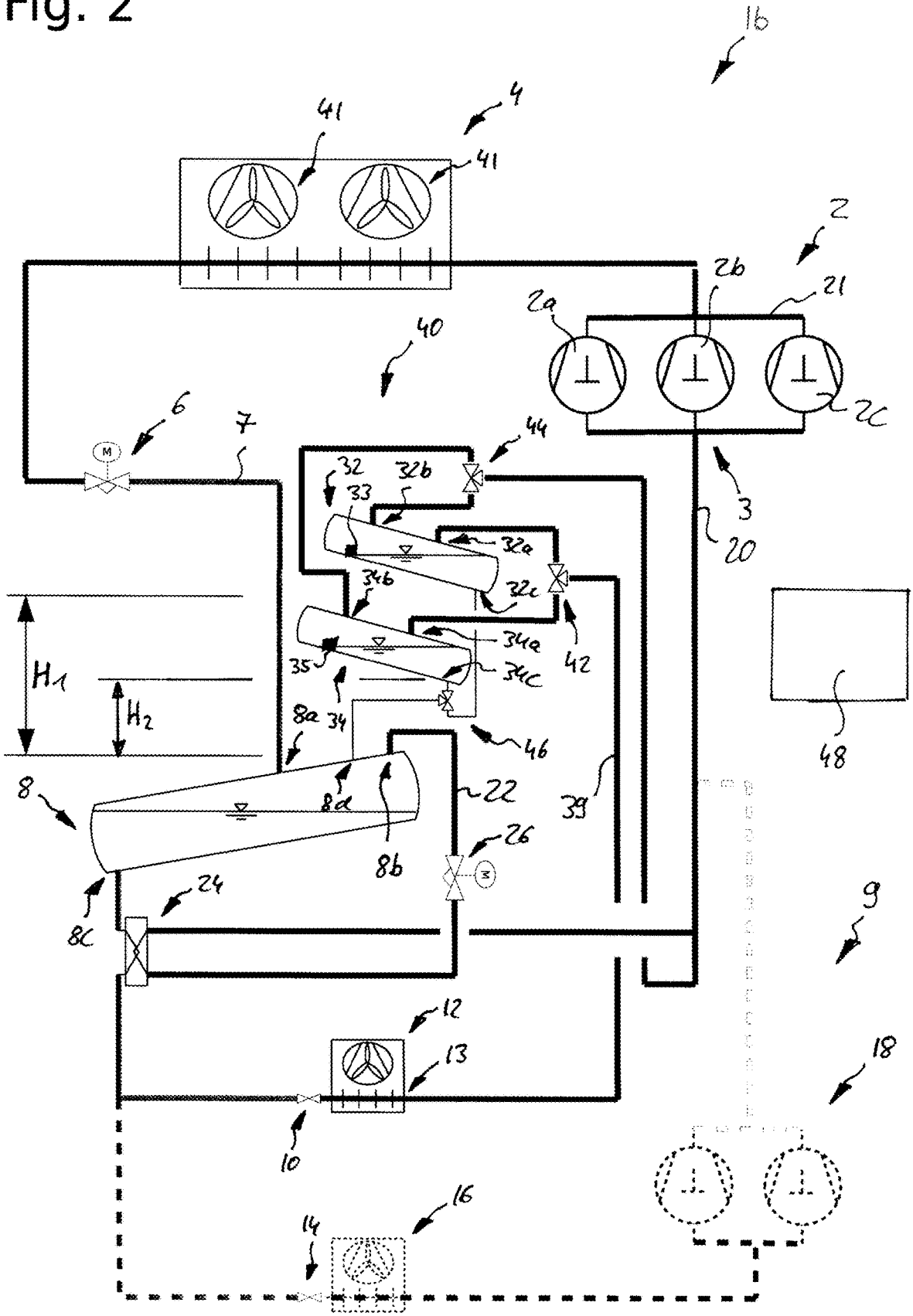
FIG. 2 is a schematic view of a refrigeration circuit 1*b* according to a second exemplary embodiment of the invention.

FIG. 2 illustrates a refrigeration circuit 1*b* according to a second exemplary embodiment of the invention.

The refrigeration circuit 1*b* according to a second exemplary embodiment differs from the refrigeration circuit 1*a* according to the first embodiment shown in FIG. 1 only in the configuration of the low pressure gas-liquid-separator 30, 40.

Thus, the components of the refrigeration circuit 1*b* according to the second embodiment which are identical to the components of the refrigeration circuit 1*a* according to the first embodiment shown in FIG. 1 are denoted with the same reference signs and are not discussed in detail again.

According to the second exemplary embodiment shown in FIG. 2, the low pressure gas-liquid-separator 40 comprises two similar, in particular identical, collecting containers 32, 34 which are arranged in some height $H_1$, $H_2$, in particular between 1 and 3 m, more particularly 2 m, above the receiver 8. In FIG. 2 the collecting containers 32, 34 are depicted at different heights $H_1$, $H_2$ for reasons of illustration. In practice, the collecting containers 32, 34 may be arranged at the same height $H=H_1=H_2$, or at different heights $H_1$, $H_2$, as long as both collecting containers 32, 34 are arranged at a higher level than the receiver 8.

Both collecting containers 32, 34 have a cross-section (diameter) that is considerable larger than the cross-section (diameter) of the low pressure refrigerant line 39.

The low pressure gas-liquid-separator 40 according to the second exemplary embodiment further comprises a gas inlet valve unit 42, a gas outlet valve unit 44 and a liquid outlet valve unit 46.

The gas inlet valve unit 42 is configured for alternatively connecting the low pressure refrigerant line 39 to an inlet 32*a*, 34*a* of either of the two collecting containers 32, 34.

The gas outlet valve unit 44 is configured for alternatively connecting the refrigerant suction line 20 of the compressor unit 2 to the gas outlet 32*b*, 34*b* of either of the two collecting containers 32, 34, and the liquid outlet valve unit 46 is configured for alternatively connecting the second inlet 8*d* of the receiver 8 to the liquid outlet 32*c*, 34*c* of either of the two collecting containers 32, 34.

Each of the valve units 42, 44, 46 may comprise a three-way valve, as it is shown in FIG. 2, or a suitable combination of two-way valves, respectively.

The control unit 48 is configured for causing the valve units 42, 44, 46 to alternately switch between two modes of operation:

In a first mode of operation the low pressure refrigerant line 39 is fluidly connected to the inlet 32*a* of a first collecting container 32, the refrigerant suction line 20 of the compressor unit 2 is fluidly connected to the gas outlet 32*b* of the first collecting container 32, and the liquid outlet 32*c* of the first collecting container 32 is separated from the receiver 8. The second inlet 8*b* of the receiver 8 is at least temporarily fluidly connected to a liquid outlet 34*c* of the second collecting container 34.

In said first mode of operation refrigerant which is supplied from the normal cooling temperature evaporator 12 and which may comprise a gas phase portion and a liquid phase portion flows into the first collecting container 32. In the first collecting container 32 the gas phase portion of the refrigerant separates from the liquid phase portion, as it has been described before with reference to the low pressure gas-liquid-separator 30 shown in FIG. 1. The gas phase portion is delivered via the gas outlet 32*b* and the gas outlet valve unit 44 to the refrigerant suction line 20 of the compressor unit 2 while the liquid phase portion collects at the bottom of the first collecting container 32.

Simultaneously the liquid outlet valve unit 46 at least temporarily fluidly connects the liquid outlet 34*c* of the second collecting container 34 with the receiver 8, and liquid refrigerant, which has been collected before in the second collecting container 34, is allowed to flow, driven by forces of gravity, via the liquid outlet 34*c* and the liquid outlet valve unit 46 from the second collecting container 34 into the receiver 8.

After some time of operation and/or after a certain amount of liquid refrigerant has been collected in the first collecting container 32, the valve units 42, 44, 46 a switched from the first mode to the second mode of operation.

In order to allow switching between the two modes based on the amount of liquid refrigerant collected at the bottom of the first collecting container 32, the amount of liquid refrigerant collected in the first collecting container 32 may be detected by a first liquid level sensor 33 arranged within or at the first collecting container 32.

In said second mode of operation the low pressure refrigerant line 39 is fluidly connected to the inlet 34*a* of the second collecting container 34, the refrigerant suction line 20 of the compressor unit 2 is fluidly connected to the gas outlet 34*b* of the second collecting container 34, and the liquid outlet 34*c* of the second collecting container 34 is separated from the receiver 8. The second inlet 8*b* of the receiver 8 is at least temporarily fluidly connected to a liquid outlet 32*c* of the first collecting container 32.

In consequence, refrigerant supplied from the normal cooling temperature evaporator 12 flows into the second collecting container 34, where the liquid phase portion of the refrigerant is separated from its liquid phase portion, as it has been described before with reference to the first collecting container 32. The separated gas phase portion is delivered via the gas outlet 34*b* and the gas outlet valve unit 44 into the refrigerant suction line 20 of the compressor unit 2 while the liquid phase portion collects at the bottom of the second collecting container 34.

Simultaneously, the liquid outlet valve unit 46 at least temporarily fluidly connects the liquid outlet 32*c* of the first collecting container 32 with the receiver 8, the liquid refrigerant collected a the bottom of the first collecting container 32 during the first mode of operation is allowed to flow, driven by forces of gravity, via the liquid outlet 32*c* and the liquid outlet valve unit 46 from the first collecting container 32 into the receiver 8.

After some further time of operation and/or after a certain amount of liquid refrigerant has been collected in the second collecting container 34, the valve units 42, 44, 46 a switched back from the second mode of operation to the first mode of operation.

In order to allow switching between the two modes base on the amount of liquid refrigerant that has been collected in the second collecting container 34, the amount of liquid refrigerant collected in the second collecting container 34 may be detected by a second liquid level sensor 35 arranged within or at the second collecting container 34.

In summary, according to the second exemplary embodiment, alternately one of the collecting containers 32, 34 is used for separating the liquid phase portion of the gas phase portion of the refrigerant, while the other collecting container 34, 32 is allowed to empty by delivering liquid refrigerant collected at the bottom of the collecting container 34, 32 into the receiver 8.

In the second exemplary embodiment, the combination of the valve units 42, 44, 46 acts as a pressure lock separating the medium pressure within the receiver 8 from the low pressure in the low pressure refrigerant line 39 but allowing liquid refrigerant to selectively flow from each of the collecting containers 32, 34 back into the receiver 8.

Figure 3:
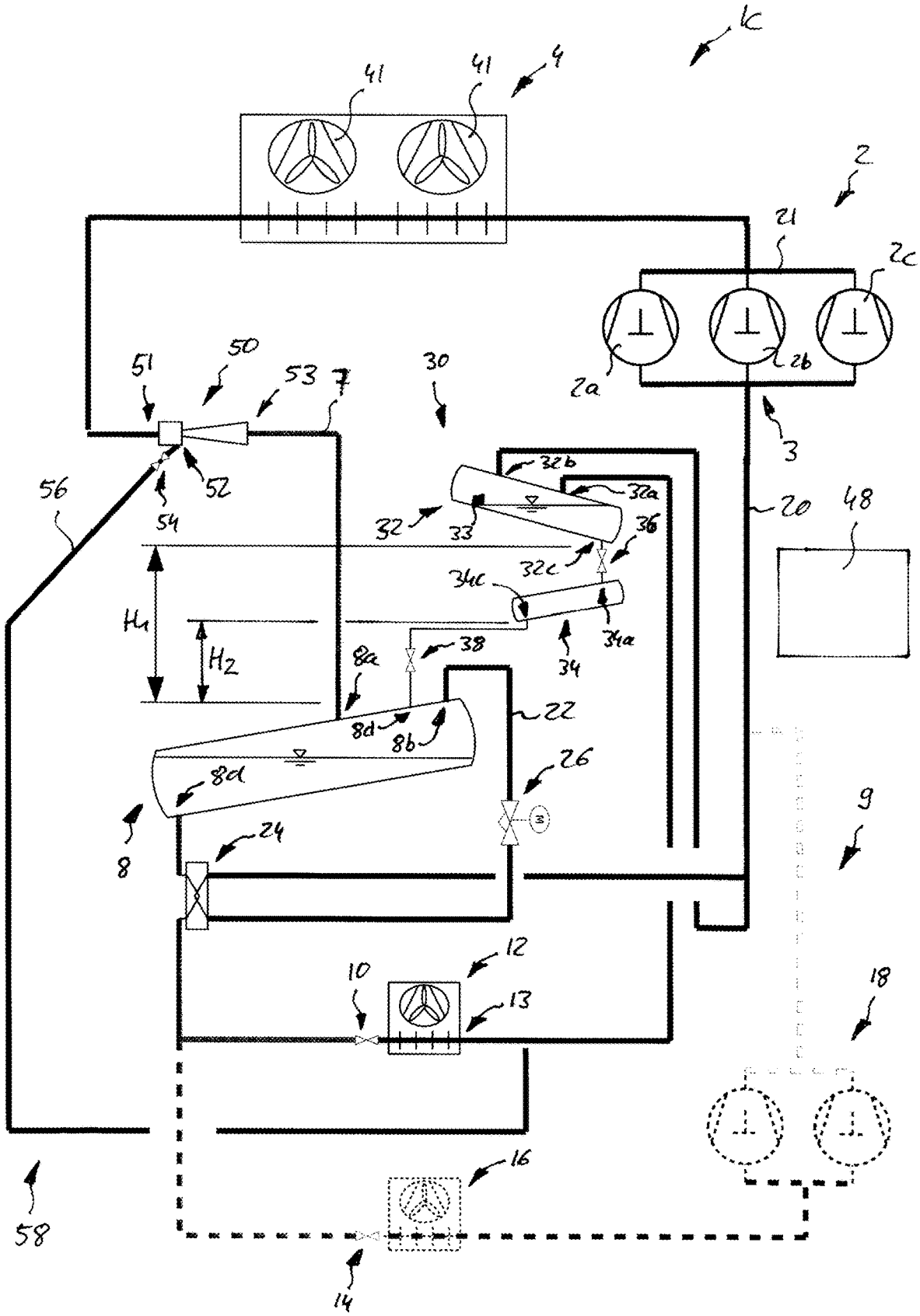
FIG. 3 is a schematic view of a refrigeration circuit 1*c* according to a third exemplary embodiment of the invention.

FIG. 3 illustrates a refrigeration circuit 1*c* according to a third exemplary embodiment of the invention.

The refrigeration circuit 1*c* according to the third embodiment is similar to the refrigeration circuit 1*a* according to the first embodiment shown in FIG. 1. In particular, the configuration of its low pressure gas-liquid-separator 30 according to the third embodiment is identical to the configuration of the low pressure gas-liquid-separator 30 of the refrigeration circuit 1*a* according to the first embodiment shown in FIG. 1.

Thus, the components of the refrigeration circuit 1*b* according to the third embodiment which are identical with the components of the first embodiment shown in FIG. 1 are denoted with the same reference signs and will no be discussed in detail again. In particular, the operation of the low pressure gas-liquid-separator 30 is identical to operation of the low pressure gas-liquid-separator 30 of the refrigeration circuit 1*a* according to the first embodiment shown in FIG. 1 and therefore will not be described again.

The refrigeration circuit 1*c* according to the third embodiment differs from the refrigeration circuit 1*a* according to the first embodiment in that the high pressure expansion device is an ejector 50. A high pressure inlet port 51 of the ejector 50 is fluidly connected to the outlet of the heat rejection heat exchanger/gas cooler 4 and a medium pressure outlet port 53 of the ejector 50 is fluidly connected via the receiver inlet line 7 to the first inlet 8*a* of the receiver 8.

The ejector 50 further comprises a suction inlet 52. The suction inlet 52 is fluidly connected via an ejector inlet line 56 comprising an ejector inlet valve 54 to the low pressure refrigerant line 39 downstream of the normal cooling temperature evaporator 12.

By opening the ejector inlet valve 54 the operation of the refrigeration circuit 1*c* according to the third embodiment may be switched into an ejector mode. When the refrigeration circuit 1*c* is operated in the ejector mode, a portion of the liquid exiting from the normal cooling temperature evaporator 12 is sucked through the ejector inlet line 56 and the ejector inlet valve 54 into the suction inlet 52 of the ejector 50. This constitutes an ejector cycle 58 with some refrigerant flowing from the outlet port 53 of the ejector 50 through the receiver 8, the optional flash-gas heat exchanger 24, the normal cooling temperature expansion device 10, the normal cooling temperature evaporator 12, and the ejector inlet valve 54 back into the suction inlet 52 of the ejector 50.

Figure 4:
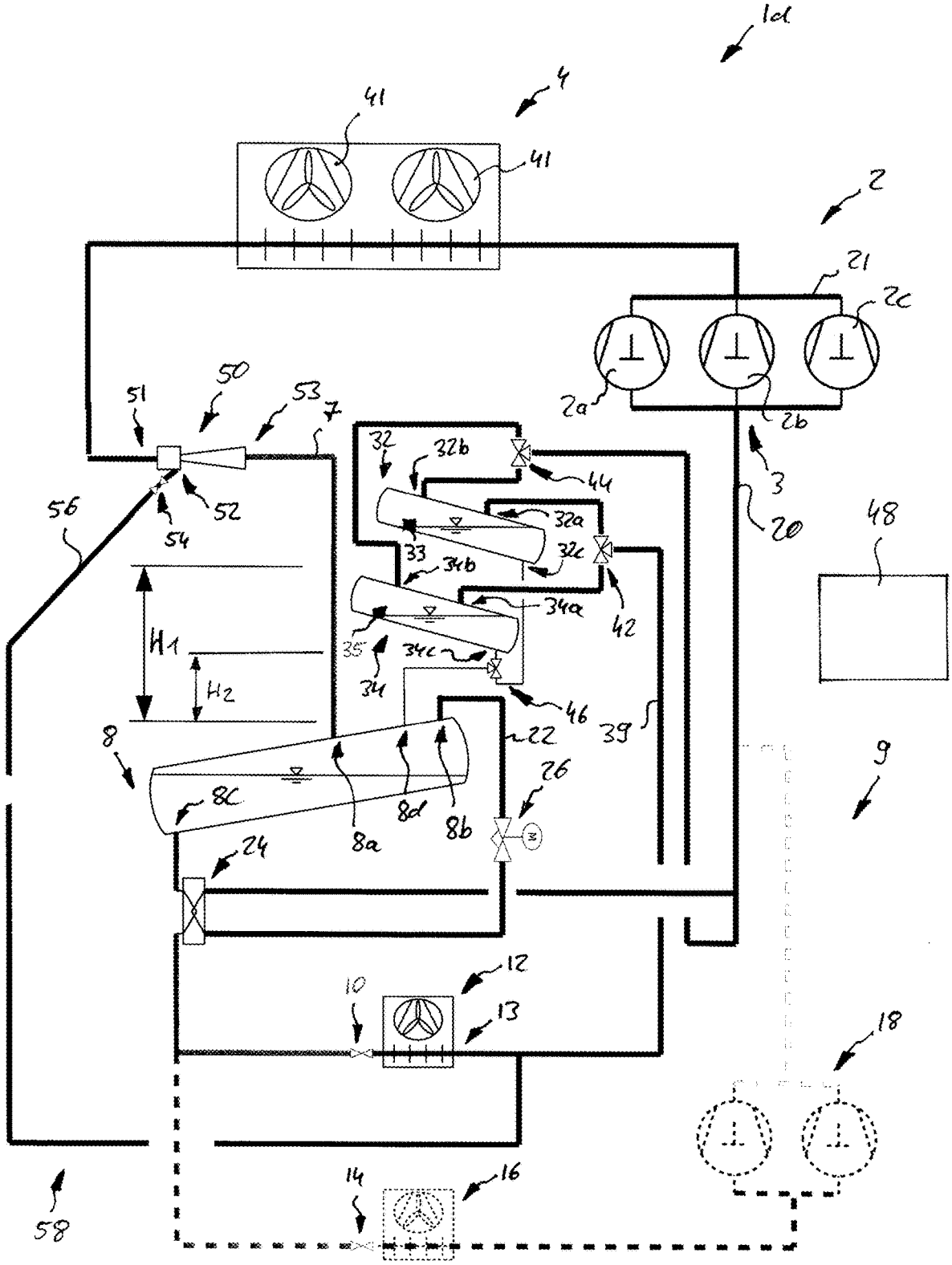
FIG. 4 is a schematic view of a refrigeration circuit 1*d* according to a fourth exemplary embodiment of the invention.

FIG. 4 shows a refrigeration circuit 1*d* according to a fourth exemplary embodiment of the invention.

The refrigeration circuit 1*d* according to the third embodiment is similar to the refrigeration circuit 1*b* according to the second embodiment shown in FIG. 2. In particular the configuration of its low pressure gas-liquid-separator 40 is identical to the configuration of its low pressure gas-liquid-separator 40 of the refrigeration circuit 1*b* according to the second embodiment shown in FIG. 2.

Thus, the components of the refrigeration circuit 1*d* according to the fourth embodiment corresponding with the components of the second embodiment shown in FIG. 2 are denoted with the same reference signs and will no be discussed in detail again. In particular, the operation of the low pressure gas-liquid-separator 40 is identical with the operation of the low pressure gas-liquid-separator 40 of the refrigeration circuit 2 according to the second embodiment shown in FIG. 2 and therefore will not be described again.

The refrigeration circuit 1*d* according to the fourth embodiment differs from the refrigeration circuit 1*b* according to the second embodiment in that the high pressure expansion device is an ejector 50. The high pressure inlet port 51 of the ejector 50 is fluidly connected to the outlet of the heat rejection heat exchanger/gas cooler 4 and the medium pressure outlet port 53 of the ejector 50 is fluidly connected via the receiver inlet line 7 with the first inlet 8*a* of the receiver 8.

The ejector 50 further comprises a suction inlet 52. The suction inlet 52 is fluidly connected via an ejector inlet line 56 comprising an ejector inlet valve 54 to the low pressure refrigerant line 39 downstream of the normal cooling temperature evaporator 12.

By opening the ejector inlet valve 54 the operation of the refrigeration circuit 1*d* according to the fourth embodiment may be switched into an ejector mode. When the refrigeration circuit 1*d* is operated in the ejector mode, a portion of the liquid exiting from the normal cooling temperature evaporator 12 is sucked through the ejector inlet line 56 and the ejector inlet valve 54 into the suction inlet 52 of the ejector 50. This constitutes an ejector cycle 58 with some refrigerant flowing from the outlet port 53 of the ejector 50 through the receiver 8, the optional flash-gas heat exchanger 24, the normal cooling temperature expansion device 10, the normal cooling temperature evaporator 12, and the ejector inlet valve 54 back into the suction inlet 52 of the ejector 50.

Operating a refrigeration circuit 1*c*, 1*d* in the ejector mode may enhance the efficiency of the refrigeration circuit 1*c*, 1*d* under some operational and environmental conditions, in particular when the high outside temperatures are high resulting in a relatively high temperature of the heat rejection heat exchanger/gas cooler 4.

Separating the liquid phase portion of the refrigerant from the gas phase portion by means of a low pressure gas-liquid-separator 30, 40, as it has been described with reference to the exemplary embodiments, avoids liquid refrigerant from being sucked into the compressor unit 2. This enhances the efficiency of the refrigeration circuit 1*a*, 1*b*, 1*c*, 1*d*, in particular when the outside temperatures and in consequence also the temperature of the heat rejection heat exchanger/gas cooler 4 are relatively low.

As a result, refrigeration circuits 1*a*, 1*b*, 1*c*, 1*d* according to exemplary embodiments of the invention may be operated very efficiently over a wide range of ambient temperatures.

A number of optional features are set out in the following. These features may be realized in particular embodiments, alone or in combination with any of the other features.

In one embodiment the collecting containers are arranged above the receiver, particularly between 1 m and 3 m, more particularly 2 m, above the receiver. In one embodiment, the first collecting container is arranged above the second collecting container, particularly between 1 m and 3 m, more particularly 2 m, above the second collecting container and the second collecting container is arranged above the receiver, particularly between 1 m and 3 m, more particularly 2 m, above the receiver. Such a configuration allows transferring liquid phase refrigerant from the first collecting container into the second collecting container and/or from the collecting container(s) into the receiver driven by forces of gravity. This avoids the need for providing an additional pumping mechanism. The skilled person understands that the containers do not need to be arranged directly above, i.e. on a common vertical line with, the receiver. Instead, it is sufficient that the containers are arranged at a level of height which is above the level of height of the receiver.

In one embodiment the refrigeration circuit further comprises a control unit which is configured for controlling the valve units to switch between at least two modes including: a first mode, in which the outlet of the normal cooling temperature evaporator is fluidly connected to the inlet of a first collecting container, the inlet side of the compressor unit is fluidly connected to the gas outlet of the first collecting container and the first collecting container is fluidly separated from the receiver; and a second mode, in which the outlet of the normal cooling temperature evaporator is fluidly connected to the inlet of the second collecting container, the inlet side of the compressor unit is fluidly connected to the gas outlet of the second collecting container and the second collecting container is fluidly separated from the receiver.

This allows to separate the liquid phase portion from the gas phase portion of the refrigerant in one of the collecting containers while maintaining a pressure difference between the said collecting container and the receiver.

In one embodiment the inlet of the receiver is at least temporarily fluidly connected to a liquid outlet of a second collecting container in the first mode; and the inlet of the receiver is at least temporarily fluidly connected to a liquid outlet of the first collecting container in the second mode.

This allows transferring liquid refrigerant collected in one of the containers, back into the receiver while maintaining a pressure difference between the low pressure refrigerant line/refrigerant suction line and the receiver.

In one embodiment the refrigeration circuit further comprises a control unit which is configured for controlling the inlet and outlet valves to switch between a liquid collection mode, in which both valves are closed; a first liquid transfer mode, in which the inlet valve is open and the outlet valve is closed; and a second liquid transfer mode, in which the inlet valve is closed and the outlet valve is open.

A control unit according to any of these embodiments allows separating the liquid phase portion from the refrigerant leaving the evaporator and to transfer the separated liquid phase portion back in to the receiver without providing a mechanical pumping mechanism.

In one embodiment the control unit is configured for alternately switching between the modes with a predetermined frequency. This allows providing a simple and inexpensive control unit using a simple timer for switching between the modes.

In one embodiment the refrigeration circuit further comprises a liquid level sensor in or at at least one of the collecting containers and the control unit is configured for alternately switching between the modes based on the levels of liquid detected by the liquid level sensor(s). Using liquid level sensors allows for a very effective switching between the modes and reliably avoids any overflow of the containers by liquid refrigerant.

In one embodiment the high pressure expansion device is a high pressure expansion valve. A high pressure expansion valve provides a reliable and inexpensive high pressure expansion device.

In one embodiment the high pressure expansion device is an ejector. The ejector in particular may comprise a high pressure inlet port fluidly connected to the outlet side of the heat rejecting heat exchanger/gas cooler, an ejector suction port fluidly connected via an ejector inlet valve to the outlet of the normal cooling temperature evaporator, and an outlet port fluidly connected to the receiver. A refrigeration circuit comprising an ejector as the high pressure expansion device may be operated with enhanced efficiency at specific environmental conditions.

In one embodiment the refrigeration circuit further comprises a flash-gas line fluidly connecting a gas outlet of the receiver to the inlet side of the compressor unit. The flash-gas line in particular may comprise a least one of a flash-gas valve and/or a flash-gas heat exchanger configured for effecting heat exchange between flash-gas flowing through the flash-gas line and refrigerant exiting from the receiver via a liquid outlet. Providing and using such a flash-gas line may enhance the efficiency the refrigeration circuit.

In one embodiment the refrigeration circuit further comprises a freezing temperature branch fluidly connected between a liquid outlet of the receiver, particularly at a position between the receiver and the expansion device and an inlet of the compressor unit, particularly at a position between the low pressure gas-liquid-separation unit, and the compressor unit. The freezing temperature branch may comprise a freezing temperature expansion device, a freezing temperature evaporator and a freezing temperature compressor unit. Such a freezing temperature branch allows providing freezing temperatures in addition to the "normal" cooling temperatures. Thus, a single refrigeration circuit may provide simultaneously both, "normal" cooling temperatures as well as freezing temperatures. This allows providing two different cooling temperatures at low costs.

While the invention has been described with reference to exemplary embodiments, it will be understood by those skilled in the art that various changes may be made and equivalence may be substitute for elements thereof without departing from the scope of the invention. In particular, modifications may be made to adapt a particular situation or material to the teachings of the invention without departing from the essential scope thereof. Therefore, it is intended that the invention is not limited to the particular embodiments disclosed, but that the invention will include all embodiments falling within the scope of the pending claims.

REFERENCES

1*a* refrigeration circuit (first embodiment)
1*b* refrigeration circuit (second embodiment)
1*c* refrigeration circuit (third embodiment)
1*d* refrigeration circuit (fourth embodiment)
2 compressor unit
2*a* economizer compressor
2*b*, 2*c* standard compressors
3 inlet side of the compressor unit
4 heat rejection heat exchanger/gas cooler
6 high pressure expansion device/high pressure expansion device valve
7 receiver inlet line
8 receiver
8*a* first inlet of the receiver
8*b* gas outlet inlet of the receiver
8*c* liquid outlet of the receiver
8*d* second inlet of the receiver
9 low temperature branch
10 (normal cooling temperature) expansion device
12 (normal cooling temperature) evaporator
13 outlet of the (normal cooling temperature) evaporator
14 freezing temperature expansion device
16 freezing temperature evaporator
18 freezing temperature compressor unit
18*a*, 18*b* freezing temperature compressors
20 refrigerant suction line of the compressor unit
21 outlet manifold
22 flash-gas line
24 flash-gas heat exchanger
26 flash-gas valve
30 low pressure gas-liquid-separator (first and third embodiment)
32 first collecting container
32*a* inlet of the first collecting container
32*b* gas outlet of the first collecting container
32*c* liquid outlet of the first collecting container
33 (first) liquid level sensor
34 second collecting container
34*a* inlet of the second collecting container
34*b* gas outlet of the second collecting container
34*c* liquid outlet of the second collecting container
35 second liquid level sensor
36 inlet valve of the second collecting container
38 outlet valve of the second collecting container
39 low pressure refrigerant line
40 low pressure gas-liquid-separator (second and fourth embodiment)
41 fans
42 inlet valve unit
44 gas outlet valve unit
46 liquid outlet valve unit
48 control unit
50 high pressure expansion device/ejector
51 high pressure inlet port of the ejector
52 suction inlet of the ejector
53 outlet port of the ejector
54 ejector inlet valve
56 ejector inlet line
58 ejector cycle
$H_1$ height of the first collecting container
$H_2$ height of the second collecting container

The invention claimed is:

1. A refrigeration circuit comprising in the direction of flow of a circulating refrigerant:

a compressor unit comprising at least one compressor the compressor unit comprising an inlet and an outlet;

a heat rejecting heat exchanger/gas cooler comprising an inlet and an outlet, wherein the outlet of the compressor unit is in direct fluid connection with the inlet of the heat rejecting heat exchanger/gas cooler;

a high pressure expansion device comprising an inlet and an outlet, wherein the outlet of the heat rejecting heat exchanger/gas cooler is in direct fluid connection with the inlet of the high pressure expansion device;

a receiver comprising a first inlet, a second inlet and an outlet, wherein the outlet of the high pressure expansion device is in direct fluid connection with the first inlet of the receiver;

an expansion device comprising an inlet and an outlet, wherein the outlet of the receiver is in direct fluid connection with the inlet of the expansion device;

an evaporator comprising an inlet and an outlet, wherein the outlet of the expansion device is in direct fluid connection with the inlet of the evaporator; and a low pressure gas-liquid-separation unit comprising a first collecting container and a second collecting container; wherein the outlet of the evaporator is in direct fluid connection with an inlet of the first collecting container;

the inlet the compressor unit is in direct fluid connection with a gas outlet of the first collecting container;

a liquid outlet of the first collecting container is, via an inlet valve, in direct fluid connection with an inlet of the second collecting container; and a liquid outlet of the second collecting container is, via an outlet valve, in direct fluid connection with the second inlet of the receiver.

2. The refrigeration circuit according to claim 1, wherein the second collecting container is arranged above the receiver and wherein the first collecting container is arranged above the second collecting container.

3. The refrigeration circuit according to claim 1, wherein the high pressure expansion device is a high pressure expansion valve.

4. The refrigeration circuit according to claim 1, wherein the high pressure expansion device is an ejector comprising a high pressure inlet port fluidly connected to the outlet of the heat rejecting heat exchanger/gas cooler, an ejector suction port fluidly connected via an ejector inlet valve to the outlet of the evaporator, and an outlet port fluidly connected to the first inlet of the receiver.

5. The refrigeration circuit according to claim 1 further comprising a flash-gas line fluidly connecting a gas outlet of the receiver to the inlet of the compressor unit; the flash-gas line comprising a least one of a flash-gas valve and a flash-gas heat exchanger configured to effectuate heat exchange between flash-gas flowing through the flash-gas line and refrigerant exiting from the receiver via a liquid outlet.

6. The refrigeration circuit according to claim 1 further comprising a freezing temperature branch fluidly connected between a liquid outlet of the receiver at a position between the receiver and the expansion device and the inlet of the compressor unit at a position between the low pressure gas-liquid-separation unit, and the compressor unit, the freezing temperature branch comprising a freezing temperature expansion device, a freezing temperature evaporator and a freezing temperature compressor unit.

7. A refrigeration circuit comprising in the direction of flow of a circulating refrigerant:

a compressor unit comprising at least one compressor, an inlet and an outlet;

a heat rejecting heat exchanger/gas cooler comprising an inlet and an outlet, wherein the outlet of the compressor unit is in direct fluid connection with the inlet of the heat rejecting heat exchanger/gas cooler;

a high pressure expansion device comprising an inlet and an outlet, wherein the outlet of the heat rejecting heat exchanger/gas cooler is in direct fluid connection with the inlet of the high pressure expansion device;

a receiver comprising a first inlet, a second inlet and an outlet, wherein the outlet of the high pressure expansion device is in direct fluid connection with the first inlet of the receiver;

an expansion device comprising an inlet and an outlet, wherein the outlet of the receiver is in direct fluid connection with the inlet of the expansion device;

an evaporator comprising an inlet and an outlet, wherein the outlet of the expansion device is in direct fluid connection with the inlet of the evaporator;

a low pressure gas-liquid-separation unit comprising collecting containers;

an inlet valve unit configured to alternately connect the outlet of the evaporator directly to an inlet of one of the collecting containers;

a gas outlet valve unit configured to alternately connect the inlet of the compressor unit directly to a gas outlet of one of the collecting containers; and a liquid outlet valve unit configured to alternately connect the second inlet of the receiver directly to a liquid outlet of one of the collecting containers.

8. The refrigeration circuit according to claim 7, wherein the collecting containers are arranged above the receiver.

9. The refrigeration circuit according to claim 8, wherein:

the inlet of the receiver is at least temporarily fluidly connected to a liquid outlet of a second collecting container of the collecting containers in the first mode; and the inlet of the receiver is at least temporarily fluidly connected to a liquid outlet of the first collecting container of the collecting containers in the second mode.

* * * * *